US008793909B1

(12) United States Patent
Cole

(10) Patent No.: US 8,793,909 B1
(45) Date of Patent: Aug. 5, 2014

(54) ILLUMINATED DISPLAY MIRROR

(71) Applicant: John A. Cole, Springboro, OH (US)

(72) Inventor: John A. Cole, Springboro, OH (US)

( * ) Notice: Subject to any disclaimer, the term of this patent is extended or adjusted under 35 U.S.C. 154(b) by 0 days.

(21) Appl. No.: 13/962,794

(22) Filed: Aug. 8, 2013

(51) Int. Cl.
*G09F 13/12* (2006.01)
*G09F 13/18* (2006.01)
*G09F 13/04* (2006.01)

(52) U.S. Cl.
CPC ..... *G09F 13/18* (2013.01); *G09F 13/0404* (2013.01); *G09F 13/12* (2013.01)
USPC ..... 40/219; 40/564

(58) Field of Classification Search
CPC ..... G09F 13/12; G09F 13/0404
USPC ..... 40/219, 564
See application file for complete search history.

(56) References Cited

U.S. PATENT DOCUMENTS

| | | | | |
|---|---|---|---|---|
| 1,202,593 | A | 10/1916 | McIntosh | |
| 1,805,798 | A | 5/1931 | Bedrossyan | |
| 2,221,889 | A | 11/1940 | White | |
| 3,997,991 | A * | 12/1976 | Hayman-Chaffey et al. | 40/361 |
| 4,747,223 | A * | 5/1988 | Borda | 40/219 |
| 5,819,452 | A * | 10/1998 | Hakkert | 40/406 |
| 8,074,386 | B2 * | 12/2011 | Marantz | 40/219 |
| 2002/0015226 | A1 * | 2/2002 | Rottcher | 359/443 |
| 2006/0242867 | A1 | 11/2006 | Choi | |
| 2006/0260155 | A1 * | 11/2006 | Molleda Leon | 40/219 |
| 2008/0115395 | A1 * | 5/2008 | Saito et al. | 40/564 |
| 2010/0058628 | A1 * | 3/2010 | Reid et al. | 40/219 |
| 2011/0056102 | A1 * | 3/2011 | Reid et al. | 40/219 |

FOREIGN PATENT DOCUMENTS

| | | |
|---|---|---|
| CN | 201402580 | 2/2010 |
| CN | 201402583 | 2/2010 |
| CN | 201741351 | 2/2011 |
| CN | 201984759 | 9/2011 |
| CN | 202230695 | 5/2012 |

* cited by examiner

*Primary Examiner* — Gary Hoge
(74) *Attorney, Agent, or Firm* — R. William Graham

(57) ABSTRACT

An illuminated display mirror includes a frame having panel receiving area defined by a front retaining portion and a side retaining portion extending rearwardly from the front retaining portion, a transparent panel to be held within said panel receiving area and having a highly reflective coating at least partially on a surface thereof and at least part of the surface free of any reflective coating and defining an image receiving area, and having a registration indicia, a light transmissive substrate having a printed image thereon and having a corresponding registration indicia formed thereon for registering the printed image in the image receiving area and a light emitting member.

14 Claims, 4 Drawing Sheets

ILLUMINATED DISPLAY MIRROR

DETAILED DESCRIPTION

1. Field of the Invention

The present invention relates to displays, and more particularly, to an illuminated mirror display for advertising.

2. Background of the Invention

Mirrors for advertising have long existed. Many of these prior art devices use a combination of decal or print on a mirror to create a desired commercial effect. The notion is to use visual attributes of reflective surfaces as a base upon which to apply product images, slogans, and logos, for example.

One prior system as seen in U.S. Pat. No. 8,074,386, discloses a mirror and graphics display system includes a sheet of substantially transparent material having a silvered or reflective region and a sheet of translucent material having a graphic. The system includes a substantially planar illumination element secured to the translucent material and also in optical communication with the transparent and translucent materials.

U.S. Pat. No. 4,747,223 discloses a device for causing a plurality of images having different optical characteristics to appear through a continuous mirrored screen. This teaches a partially transparent mirrored screen extending continuously over a preselected area and containing a distribution of reflective material which varies in optical density to define regions of differing optical transmittance to light.

While these prior techniques have met with some success, there remains a need for improvement. There exists a need in the art for an advertising mechanism which combines visual attributes of a mirror with a printed indicia and lighting element to provide a unique visual effect with an improved quality in appearance.

SUMMARY OF THE INVENTION

It is an object of the invention to improve displays of the type incorporating a mirror.

It is another object to improve advertising by use of a mirror and graphic in a unique illuminated frame.

Accordingly, the instant invention is directed to an illuminated display mirror. The mirror has a frame having panel receiving area defined by a front retaining portion and a side retaining portion extending rearwardly from the front retaining portion.

A transparent panel is provided of a size and configuration to be held within the panel receiving area and has a highly reflective coating at least partially on a surface thereof and at least part of the surface free of any reflective coating and defining an image receiving area, and further includes a perimeter surface area free of any reflective coating. A registration indicia is formed on the perimeter surface area as a function of the image receiving area and when the transparent panel is held within the frame, the indicia is covered by the front retaining portion.

A light transmissive substrate is provided having a printed image thereon, the substrate of a size and configuration to be held within the panel receiving area adjacent the transparent panel and a has perimeter surface area having a corresponding registration indicia formed thereon for registering the printed image in the image receiving area and when the light transmissive substrate is held within the frame the corresponding registration indicia and registration indicia mate and are covered by the front retaining portion.

A light emitting member, preferably an LED strip, connected to the side retaining portion rearwardly of the transparent panel and the light transmissive substrate. There can preferably be an opaque back panel disposed rearwardly of the light emitting member. The opaque member can include a reflective coating to reflect light from the light emitting member back toward the transparent panel and the light transmissive substrate.

Another embodiment is directed to an illuminated display mirror, which includes a frame having panel receiving area defined by a front retaining portion and a side retaining portion extending rearwardly from the front retaining portion, a transparent panel of a size and configuration to be held within the panel receiving area and having a highly reflective coating at least partially on a surface thereof and at least part of the surface free of any reflective coating and defining an image receiving area and when the transparent panel is held within the frame said indicia is covered by the front retaining portion. A light transmissive substrate has a printed image thereon, the substrate of a size and configuration to be held within the panel receiving area adjacent the transparent panel and a has perimeter surface area having a registration indicia formed thereon corresponding to a top and connecting side dimension of the transparent panel for registering said printed image in the image receiving area and when the light transmissive substrate is held within the frame. A light emitting member connects to the side retaining portion rearwardly of the transparent panel and the light transmissive substrate.

Still another embodiment is directed to an illuminated display mirror, which includes a frame having panel receiving area defined by a front retaining portion and a side retaining portion extending rearwardly from the front retaining portion. A transparent panel of a size and configuration is provided to be held within the panel receiving area and has a highly reflective coating at least partially on a surface thereof and at least part of the surface free of any reflective coating and defining an image receiving area and when the transparent panel is held within the frame the indicia is covered by the front retaining portion and paint is deposed upon the back of the transparent material on the second surface free of the reflective coating. A light emitting member connected to the side retaining portion rearwardly of the transparent panel and the light transmissive substrate.

The above and yet other objects and advantages of the present invention will become apparent from the hereinafter set forth Brief Description of the Drawings, Detailed Description of the Invention and Claims appended herewith.

DETAILED DESCRIPTION OF THE INVENTION

Figure 1A:
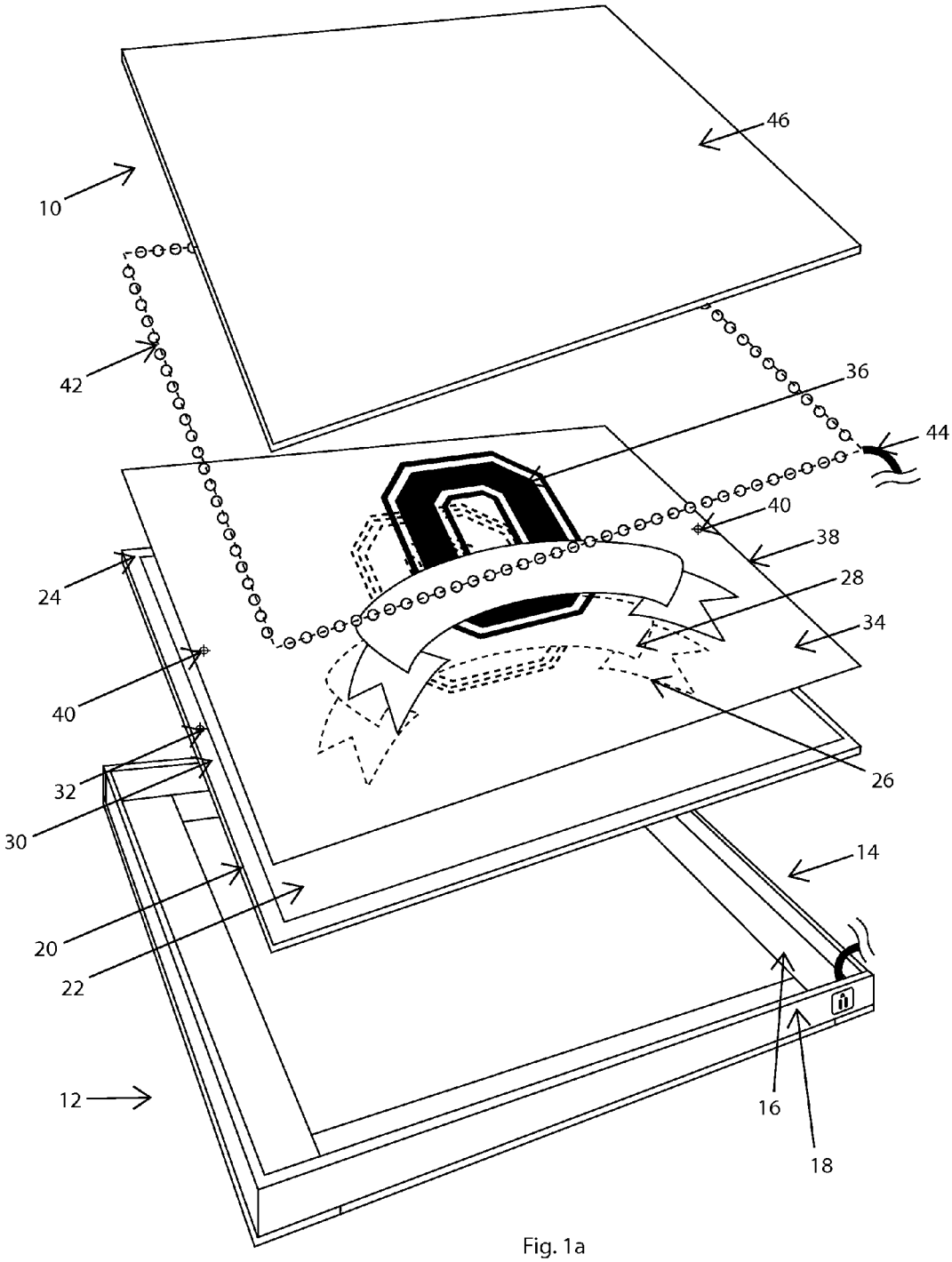
FIG. 1*a* is an exploded view of the present integrated mirror and graphics display system.

Referring now to the drawings, the invention is directed to an illuminated display mirror which is generally designated by the numeral 10. The mirror 10 has a frame 12 having panel receiving area 14 defined by a front retaining portion 16 and a side retaining portion 18 extending rearwardly from the front retaining portion 16, wherein the front portion 16 and side portion 18 can be integrally formed together. Frame 12 can be made of wood, plastic, or metal. Frame 12 may be rectangle, square, radius or combination. The profile (shape) of the frame 12 may vary except it must have a ledge (rabbit) or slot (i.e., panel receiving area 14) for attaching the components described herein.

A transparent panel 20 is provided of a size and configuration to be held within the panel receiving area 14 and has a highly reflective coating 22 at least partially coated on a surface 24 thereof and at least part 26 of the surface 24 free of any reflective coating and defining a non-reflective image receiving area 28. The transparent panel 20 further includes a perimeter surface area 30 free of any reflective coating.

A registration indicia 32 can be formed on the perimeter surface area 30 (which is representative of the area in which to receive the registration indicia 32 and may or may not include the reflective coating) as a function of the image receiving area 28 and when the transparent panel 20 is held within the frame 12, the indicia 32 is covered by the front retaining portion 16. The registration indicia 32 will be part of a non-coated area of the perimeter surface area 30 and may optionally include a print marking in such non-coated area.

The transparent panel 20 can include a sheet of substantially transparent material such as a sheet of glass. The transparent panel 20 which is coated with highly reflective coating can have the non-reflective image receiving area 28 either not coated with the reflective material or the reflective coating can be removed via solvent washing providing the non-reflective image receiving area 28. The non-reflective image receiving area 28 may be of a desired predetermined size.

A light transmissive substrate 34 is provided having a printed image 36 thereon. The light transmissive substrate 34 is of a size and configuration to be held within the panel receiving area 14 adjacent the transparent panel 20 and a has perimeter surface area 38 having a corresponding registration indicia 40 formed thereon for registering the printed image 36 in the image receiving area 28 and when the light transmissive substrate 34 is held within the frame 12 the corresponding registration indicia 40 and registration indicia 32 mate and are covered by the front retaining portion 16.

Figure 1B:
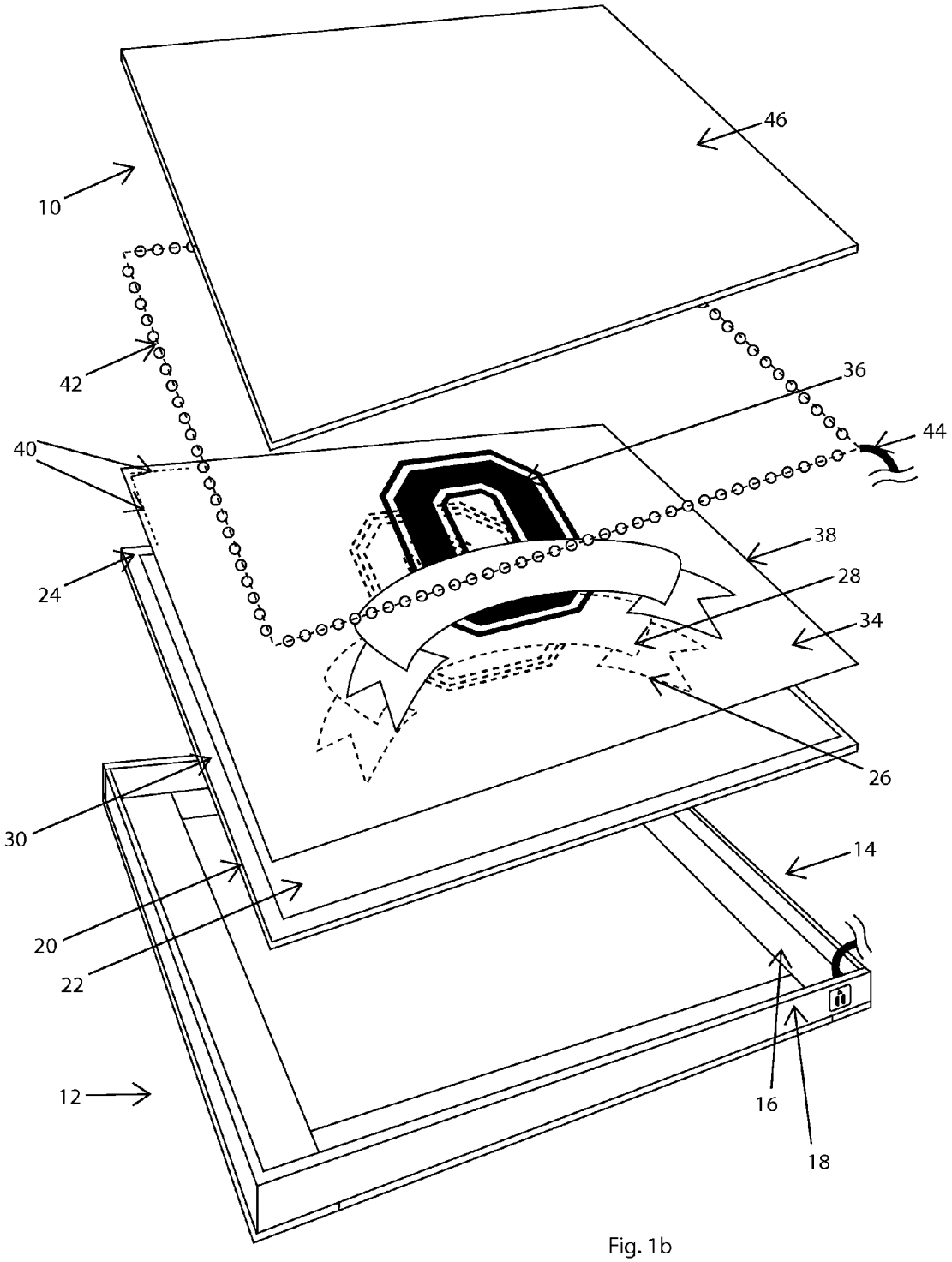
FIG. 1*b* is an exploded view of another aspect of the present integrated mirror and graphics display system.

In the case of FIG. 1*b*, the registration indicia 40 can be dotted lines formed on the light transmissive substrate 34 which can serve as cut lines. In this way, the light transmissive substrate 34 can register with a corner of the transparent panel 20.

Figure 1C:
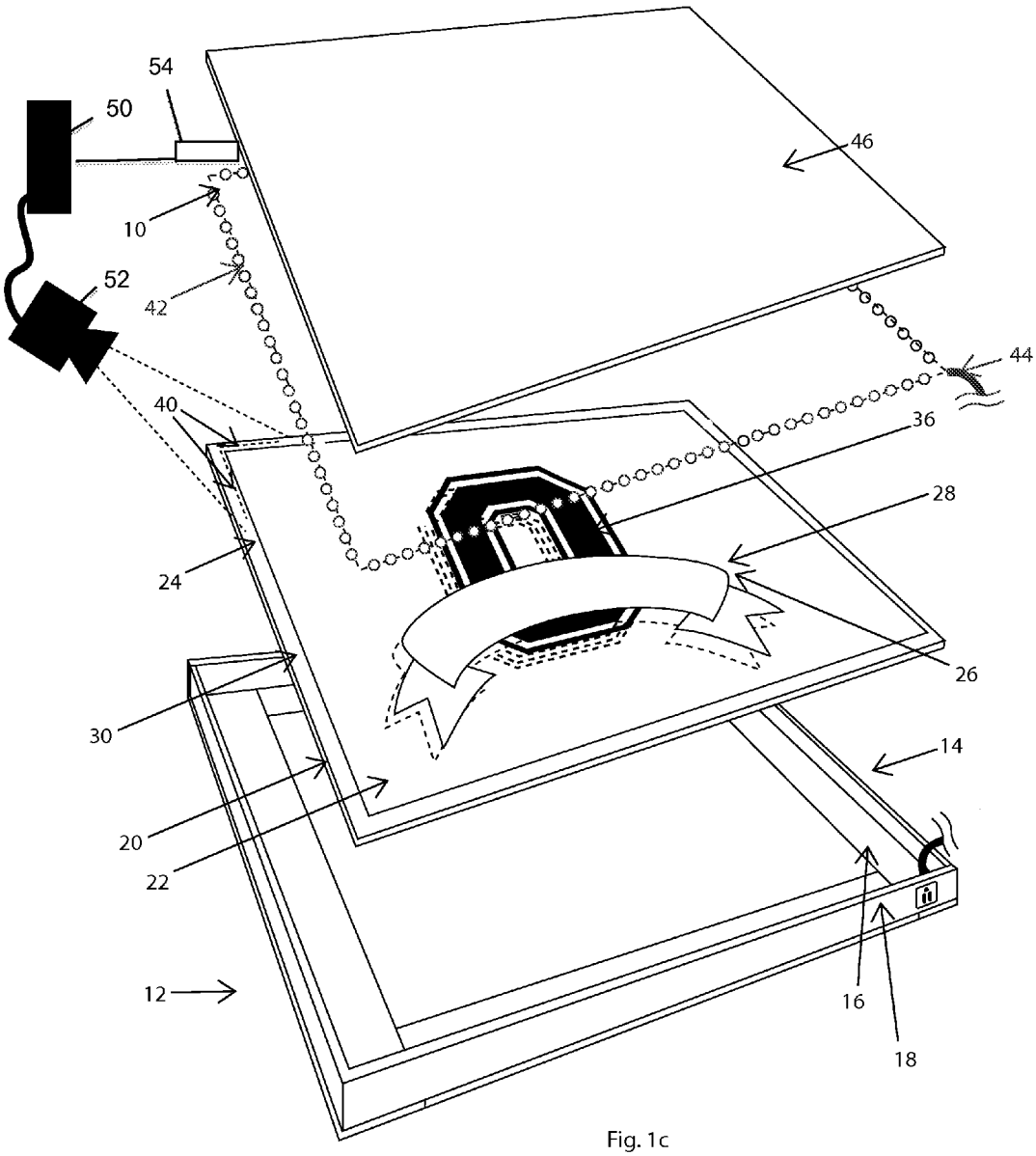
FIG. 1*c* is an exploded view of still another version of the present integrated mirror and graphics display system.
Figure 2:
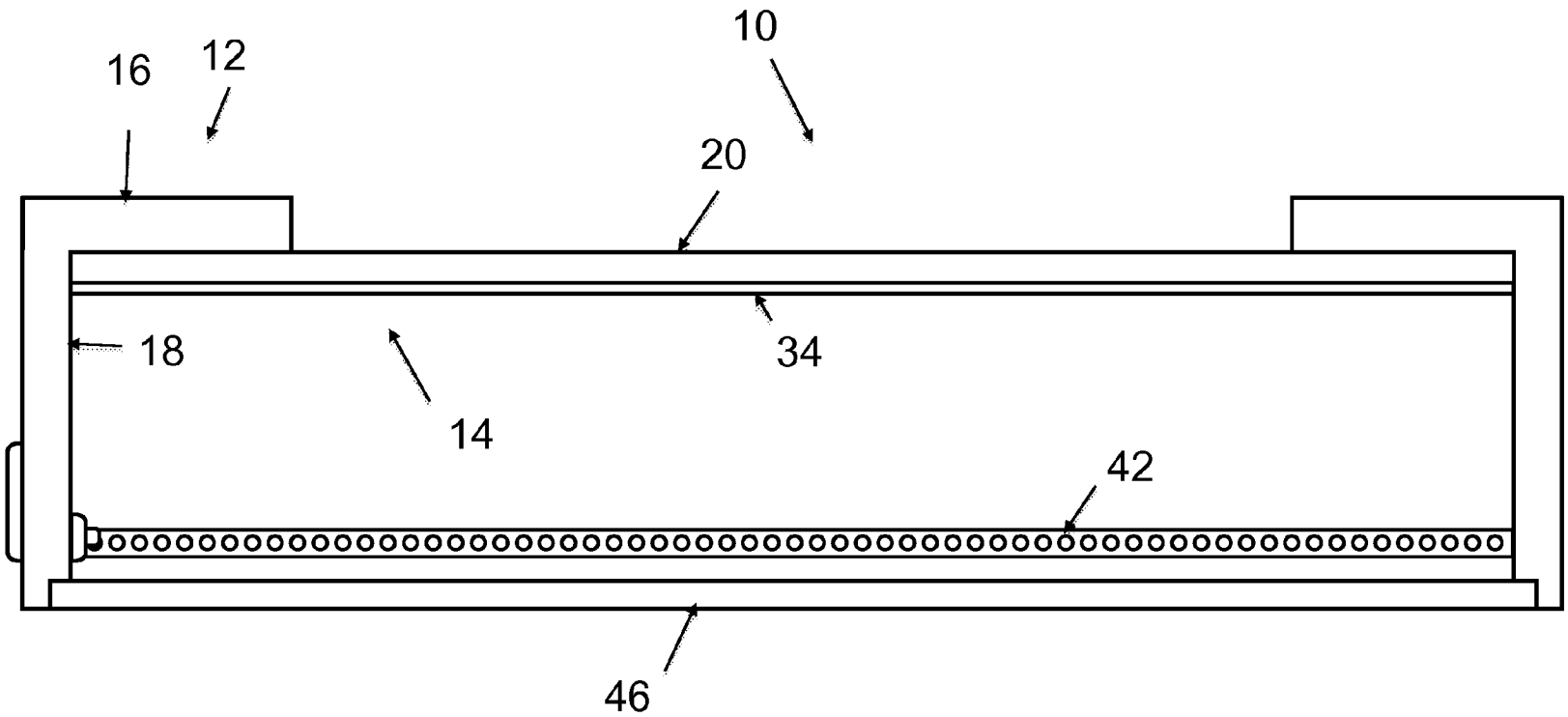
FIG. 2 is a vertical cross-sectional assembly view of the system of FIG. 1.

In FIG. 1*c*, paint can be applied in registration on the transparent panel 20 using a registration technique. In this case, a computer based device 50 can be equipped with optics 52 which is operably connected to a flat printer 54. The corner sides of transparent panel 20 can be measured relative to the image receiving area 28, and print applied to thereto using the equipment.

The printed image 36 can be formed on the light transmissive substrate 34 (film or panel) using a variety of printing methods including screen printing, digital printing, laser printing or offset printing. The printed image 36 may range from simple spot color to full color process up to photographic quality. Instead of direct printing to a film or panel, an intermediary sheet may be printed and mounted to light transmissive substrate 34. The printed image 36 can be smaller, equal to, or larger, than the non-reflective image receiving area 28.

The printed image 36 is registered to the reflective transparent panel 20 by a registration method incorporated when printing the light transmissive substrate 34. This provides a high degree of accuracy mating the clear image receiving area 28 to the printed image 36. It is contemplated that the printed image may take the form of either a sheet with print and/or printing directly upon transparent panel 20. The printed image 36 can be customer-specific information.

The light transmissive substrate 34 can be held in contact with the reflective transparent panel 20 by friction, tape, adhesive or with another light transmissive back panel. The light transmissive substrate 34 and reflective transparent panel 20 combination can be held in place with glazing pints, clips, retaining strips, caulk, glue, brackets, screws, pins or other suitable method of temporary or permanent attachment.

A light emitting member 42, preferably an LED strip, is connected to the side retaining portion 18 rearwardly of the transparent panel 20 and the light transmissive substrate 34. It is contemplated that the light emitting member 42 can be connected to back panel 46. The light emitting strip 42 (LEDs) within the geometry shown in FIG. 1 has been found to be highly desirable illumination for purposes of the present invention. An electrical cord 44 operably connects to the LED strip 42 for an external AC power source, however, batteries may also be provided, optionally internal to the matrix of LEDs, as the illumination element.

LED's 42 can be attached to the inside of the side portion 18 of the frame 12. The frame 12 can also be constructed to allow a mounting surface that will project the LED at an upward or downward angle. The side portion 18 can serve as a ledge or include a slot to receive the reflective transparent panel 20 and light transmissive substrate 34. LED's 42 (including LED circuit board, LED Strips, and LED SMD (self-mounting diodes)) which can be attached to frame 12 mechanically or with adhesive or other attachment methods.

There back panel 46 can preferably be opaque disposed rearwardly of the light emitting member 42. The opaque back panel member 46 can include a reflective coating to reflect light from the light emitting member 42 back toward the transparent panel 20 and the light transmissive substrate 34.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

What is claimed is:

1. An illuminated display mirror, which includes:

a frame having panel receiving area defined by a front retaining portion and a side retaining portion extending rearwardly from the front retaining portion;

a transparent panel of a size and configuration to be held within said panel receiving area and having a highly reflective coating at least partially on a surface thereof and at least part of the surface free of any reflective coating and defining an image receiving area, and having a perimeter surface area free of any reflective coating and having a registration indicia formed thereon as a function of said image receiving area and when said transparent panel is held within said frame said indicia is covered by the front retaining portion;

a light transmissive substrate having a printed image thereon, said substrate of a size and configuration to be held within said panel receiving area adjacent said transparent panel and a having perimeter surface area having a corresponding registration indicia formed thereon for registering said printed image in said image receiving area and when the light transmissive substrate is held within said frame said corresponding registration indicia and said registration indicia mate and are covered by the front retaining portion; and a light emitting member connected to said side retaining portion rearwardly of said transparent panel and said light transmissive substrate.

2. The illuminated display mirror of claim 1, wherein said light emitting member is an LED strip.

3. The illuminated display mirror of claim 1, which includes an opaque back panel disposed rearwardly of said light emitting member.

4. The illuminated display mirror of claim 3, wherein said opaque member includes a reflective coating to reflect light from said light emitting member back toward said transparent panel and said light transmissive substrate.

5. The illuminated display mirror of claim 1, wherein said image receiving area includes customer-specific information applied thereto.

6. The illuminated display mirror of claim 1, in which said surface free of said reflective coating is formed by masking or back-etching to define customer-specific information within said surface.

7. The illuminated display mirror of claim 1, in which said reflective coating comprises an optically reflective agent.

8. An illuminated display mirror, which includes:

a frame having panel receiving area defined by a front retaining portion and a side retaining portion extending rearwardly from the front retaining portion;

a transparent panel of a size and configuration to be held within said panel receiving area and having a highly reflective coating at least partially on a surface thereof and at least part of the surface free of any reflective coating and defining an image receiving area, and having a perimeter surface area free of any reflective coating and having a registration indicia formed thereon and when said transparent panel is held within said frame said indicia is covered by the front retaining portion;

a light transmissive substrate having a printed image thereon, said substrate of a size and configuration to be held within said panel receiving area adjacent said transparent panel and a having perimeter surface area having a registration indicia formed thereon corresponding to a top and connecting side dimension of said transparent panel for registering said printed image in said image receiving area and when the light transmissive substrate is held within said frame; and a light emitting member connected to said side retaining portion rearwardly of said transparent panel and said light transmissive substrate.

9. The illuminated display mirror of claim 8, wherein said light emitting member is an LED strip.

10. The illuminated display mirror of claim 8, which includes an opaque back panel disposed rearwardly of said light emitting member.

11. The illuminated display mirror of claim 10, wherein said opaque member includes a reflective coating to reflect light from said light emitting member back toward said transparent panel and said light transmissive substrate.

12. The illuminated display mirror of claim 8, wherein said image receiving area includes customer-specific information applied thereto.

13. The illuminated display mirror of claim 8, in which said second surface free of said reflective is formed by masking or back-etching to define customer-specific information within said region.

14. The illuminated display mirror of claim 8, in which said reflective coating comprises an optically reflective agent.

* * * * *